US012339106B2

(12) United States Patent
Smith et al.

(10) Patent No.: US 12,339,106 B2
(45) Date of Patent: Jun. 24, 2025

(54) FIBER REINFORCED BULLET AND METHOD OF MANUFACTURE

(71) Applicant: D&E HOLDINGS, Inc., Pompano Beach, FL (US)

(72) Inventors: Donald R. Smith, Pompano Beach, FL (US); Elina B. Jenkins, Pompano Beach, FL (US)

(73) Assignee: D & E Holdings, Inc., Pompano Beach, FL (US)

( * ) Notice: Subject to any disclaimer, the term of this patent is extended or adjusted under 35 U.S.C. 154(b) by 0 days.

(21) Appl. No.: 18/540,433

(22) Filed: Dec. 14, 2023

(65) Prior Publication Data

US 2024/0200919 A1 Jun. 20, 2024

Related U.S. Application Data

(60) Provisional application No. 63/387,386, filed on Dec. 14, 2022.

(51) Int. Cl.
*F42B 12/76* (2006.01)

(52) U.S. Cl.
CPC ..... *F42B 12/76* (2013.01)

(58) Field of Classification Search
CPC ..... F42B 12/76; F42B 12/72; F42B 12/74; F42B 12/745; F42B 12/78
See application file for complete search history.

(56) References Cited

U.S. PATENT DOCUMENTS 4,256,039 A * 3/1981 Gilman ..... F42B 12/06 102/517
H343 H * 10/1987 Keown ..... 102/517
4,841,868 A * 6/1989 Jackson ..... F42B 12/06 102/517
4,961,383 A * 10/1990 Fishman ..... F42B 12/74 75/229
5,528,989 A * 6/1996 Briese ..... F42B 12/34 102/516
5,569,874 A * 10/1996 Nelson ..... F42B 12/34 102/516
5,679,920 A * 10/1997 Hallis ..... F42B 12/74 102/516
5,852,255 A * 12/1998 Hallis ..... F42B 12/74 102/516
5,894,645 A * 4/1999 Hallis ..... B21F 7/00 86/54
6,010,580 A * 1/2000 Dandliker ..... F42B 12/06 428/614
6,024,021 A * 2/2000 Schultz ..... F42B 12/74 102/516

(Continued)

*Primary Examiner* — Joshua E Freeman
(74) *Attorney, Agent, or Firm* — McHale & Slavin, P.A.

(57) ABSTRACT

Bullet constructed from FRP, preferably basalt. The method includes the step of forming pultruded basalt strands positioned co-axially before milling to form a conventional bullet shape. The process uses a 10 mm FRP rod held by a revolving collet that is interfaced with an upper diamond OD grinder and a lower diamond profile wheel. Gravity allows the rod to rest on a Teflon coated cut off wheel. The upper grinder draws the rod to an exact outer dimension and the lower grinder cuts the bullet to a perfect dimension. Linear slides move the cut off wheel and grinders in for the cutting process and out to allow the finished bullet to pass.

16 Claims, 6 Drawing Sheets

(56) References Cited

U.S. PATENT DOCUMENTS

| | | | | |
|---|---|---|---|---|
| 7,204,191 | B2 * | 4/2007 | Wiley | B29C 66/612 102/517 |
| 9,273,943 | B1 * | 3/2016 | Poulsen | F42B 10/46 |
| 9,587,918 | B1 * | 3/2017 | Burrow | F42B 12/78 |
| 10,168,131 | B2 * | 1/2019 | Riess | F42B 12/74 |
| 10,641,591 | B1 * | 5/2020 | Rubin | F42B 12/46 |
| 2012/0216699 | A1 * | 8/2012 | Fanucci | F42B 12/06 86/52 |
| 2017/0082410 | A1 * | 3/2017 | Marshall | F42B 6/10 |
| 2018/0209768 | A1 * | 7/2018 | Peterson | F42B 5/067 |
| 2018/0313639 | A1 * | 11/2018 | Peterson | F42B 12/74 |
| 2019/0113320 | A1 * | 4/2019 | Folaron | F42B 12/24 |
| 2020/0173761 | A1 * | 6/2020 | Vabnick | F42B 12/06 |
| 2021/0108903 | A1 * | 4/2021 | Folaron | F42B 12/745 |
| 2023/0044162 | A1 * | 2/2023 | Maurer | F42B 10/06 |
| 2023/0152070 | A1 * | 5/2023 | Asa | C04B 41/89 501/95.2 |
| 2024/0068788 | A1 * | 2/2024 | Folaron | F42B 10/48 |

* cited by examiner

FIBER REINFORCED BULLET AND METHOD OF MANUFACTURE

PRIORITY CLAIM

In accordance with 37 C.F.R. 1.76, a claim of priority is included in an Application Data Sheet filed concurrently herewith. Accordingly, the present invention is claims priority based upon U.S. Provisional Patent Application Number 63/387,386 filed Dec. 14, 2022 entitled "FIBER REINFORCED BULLET AND METHOD OF MANUFACTURE" the contents of which are incorporated herein by reference.

FIELD OF THE INVENTION

The invention relates to the field of ammunition and, in particular, to a fiber reinforced polymer (FRP) bullet and method of manufacture.

BACKGROUND OF THE INVENTION

Ammunition for guns, rifles and large caliber weapons can be made from a variety of materials. Copper, steel, lead, brass, plastic, and the like materials, are known in the industry and collectively are used in manufacturing various types of ammunition. The size and configuration of the ammunition is based upon the application, with a myriad of types, calibers and sizes available.

Ammunition is a kinetic projectile used in guns, rifles, and the like firearms. It is estimated that over 10 billion rounds of ammunition are manufactured in the U.S. each year. The ammunition basically consists of a case and bullet secured to the case. The case is commonly made of brass, steel or copper and houses the primer and gun powder. A bullet, to which this invention is directed, is typically constructed of lead. Lead has been a favored material for bullet construction due to its unique properties for use in a projectile, including softness, malleability, ductility, poor conductivity and resistance to corrosion. However, lead is also toxic and known to contaminate meat when used for hunting. When used by a hunter, lead based bullets can fragment into hundreds of small pieces when they strike animal tissue. Should the animal escape the hunter's assault, the animal will pass on the toxic lead as part of the food chain. Lead poisoning is known to be the biggest threat to the California condors. Since condors survive on dead animals, condors are frequently exposed to the lead by consuming toxic meat. Other scavengers that are affected by consuming toxic meat include bears, vultures, ravens, hawks and eagles.

Outdoor firing ranges are found throughout the U.S. to provide skeet shooting, sporting clays, trap shooting, and rifle and gun practice. The earth is used as the backdrop to collect spent bullets. Firing ranges in the U.S. are estimated to contain hundreds of tons of lead and are technically toxic waste sites. Further, lead poisoning can be caused by the shaved lead particles that pass through the barrel, and from dust and vaporized lead gases in the air surrounding the firing range. Simply touching lead can cause exposure.

Lead is toxic for humans and known to affect most every organ in the human body. Since lead is a neurotoxin, the toxin can build up over time in bones and soft tissues. Lead poisoning can cause damage to the central nervous system, loss of memory, headaches, blood pressure changes, disorientation, and brain damage, just to name a few. The U.S. CDC provides a complete list of lead poisoning related illnesses.

What is needed in the field is an alternative to lead based bullets to reduce toxic lead from entering the food chain, prevent gun ranges from becoming toxic waste sites, and reduce gun enthusiasts from illnesses caused by exposure to lead.

SUMMARY OF THE INVENTION

FRP bullets and a method of manufacturing are disclosed. The method includes the step of forming pultruded basalt filaments positioned co-axially in a bar shape before milling; the milling process having a cut-off wheel that first operates as a positioner, wherein diamond grinders form the bar into the exact dimension of a required bullet. The cut-off wheel and grinders are moved out, allowing indexing of the bar, wherein the cut-off wheel cuts the length of the bullet.

An objective of the invention is to provide a lead free, eco-friendly nonmetallic glass bullet.

Still another objective of the invention is to provide a bullet with parallel pulled coaxially positioned filaments of glass fiber, preferably basalt, to maintain strength during acceleration out of the barrel and during flight to deliver a predictable amount of kinetic energy to a target.

Yet still another objective of the invention is to teach the use of a lava basalt rock glass fiber coaxially positioned along the length of the bullet.

Another objective of the invention is to teach that FRP exhibits no plastic scrape during loading.

Yet still another objective of the invention is to teach a glass-state FRP bullet that exhibits no buckling deformation during acceleration and enables basalt (BFRP) and glass (GFRP) projectiles superior for use with suppressors as compared to frangible, plastic or rubber bullets.

An advantage of the invention is an ultra-low-cost bullet constructed of pultruded basalt or glass versus metals or molded plastics.

Another advantage of the invention is the lighter weight of glass, as compared to metal, which results in less weight to carry and handle; and higher projectile velocity can maintain stopping power, yet address safety concerns by mitigating the energy potential beyond the target.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE PREFERRED EMBODIMENT

A detailed embodiment of the instant invention is disclosed herein; however, it is to be understood that the disclosed embodiment is merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Figure 1A:
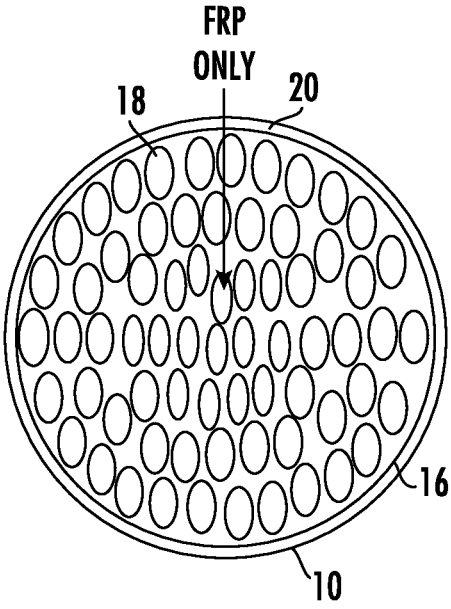
FIG. 1A is an end view of an FRP only bullet.
Figure 1B:
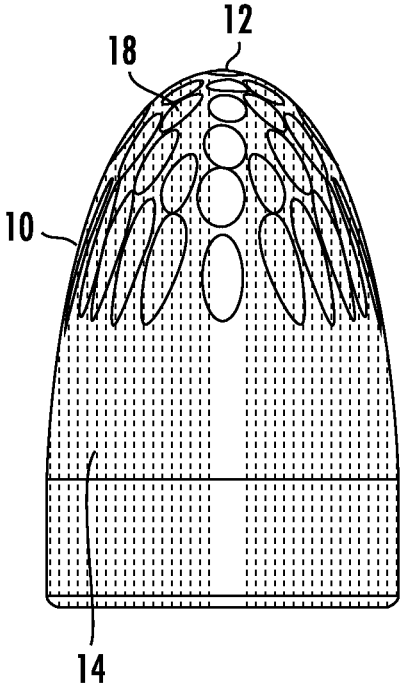
FIG. 1B is a cross-sectional side view of the FRP only bullet illustrated in FIG. 1A.
Figure 1C:
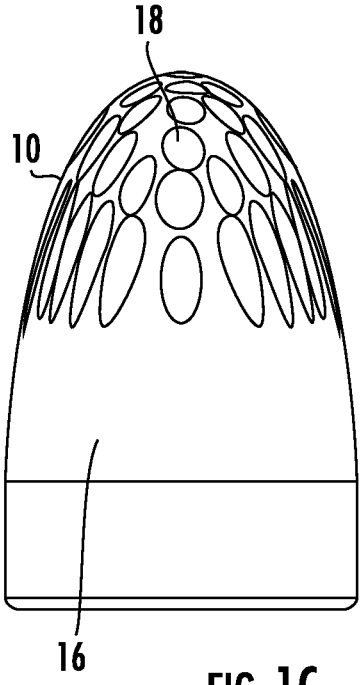
FIG. 1C is a side view of the FRP only bullet illustrated in FIGS. 1A & 1B.

Turning now to FIGS. 1A-1C, an exemplary bullet 10 embodies the present invention. The bullet 10 has a characteristic cross-sectional shape including a rounded leading edge 12 and a trailing edge 14. Composite materials suitable for use as a bullet employ a fiber reinforcement material and polymer matrix material, commonly referred to as a fiber reinforced polymer or FRP. There are many different resins that can be used with the FRP, including polyester resins, vinyl ester resins, epoxy resins, phenolic resins, polyimide resins, polyamide resins, polypropylene resins, PEEK resins, methacrylate resins, and any combinations thereof.

In a preferred embodiment, the use of basalt fibers is warranted. Alternative fibers to basalt include glass (e.g., E-glass or S-glass), nylon, polyamides (typically referred to as PA fiber), aromatic polyamides (typically referred to as aramids), Kevlar®, polyethylene (such ultra-high molecular weight as polyethylene, high-modulus polyethylene, and high-performance polyethylene), polyethylene terephthalate (typically referred to as PET fiber). Specialty strands or fibers of copper, steel, titanium, carbon, and any combination thereof can be used to vary the speed and impact damage of the projectile. The fiber reinforcement materials can be woven, braided or otherwise processed into a fabric or other suitable configurations.

The bullet 10 is formed from the composite material protruded with resin 16 surrounding the fibers 18 positioned in a co-axial or parallel direction wherein the lengths of the fibers 18 are directed to the projectile direction. The rounded leading edge 12 and trailing edge 14 expose each end of the fibers 18. In this embodiment, the fibers 18 are only used. Optionally, an outer jacket 20 can be placed over the exposed resin and fibers similar to a conventional bullet, without lead.

Figure 2A:
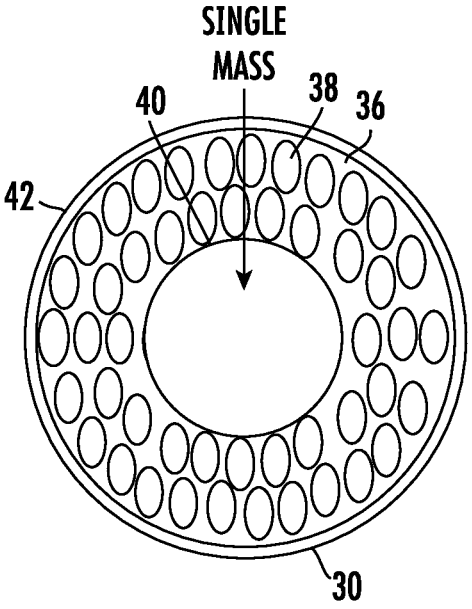
FIG. 2A is an end view of a single mass FRP bullet.
Figure 2B:
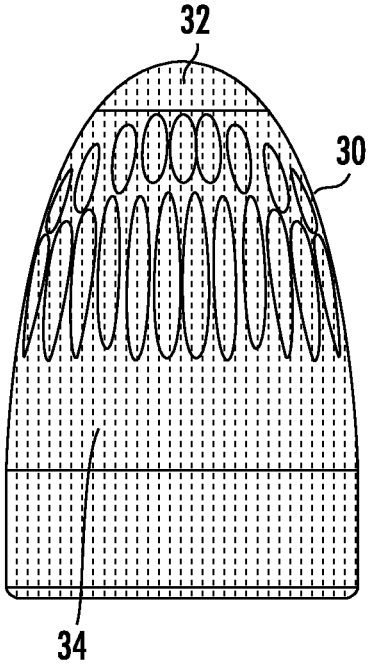
FIG. 2B is a cross-sectional side view of the single mass FRP bullet illustrated in FIG. 2A.
Figure 2C:
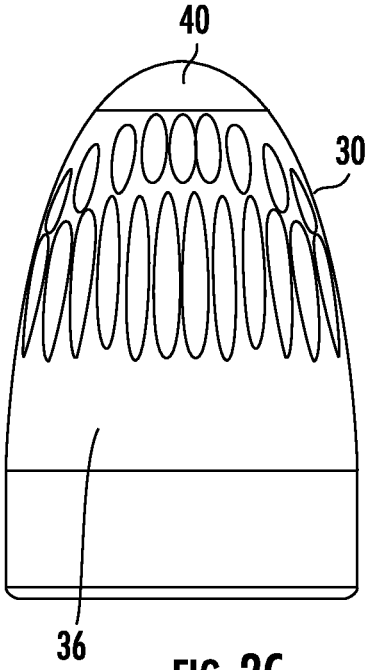
FIG. 2C is a side view of the single mass FRP bullet illustrated in FIGS. 2A & 2B.

Referring to FIGS. 2A-2C, another embodiment is depicted illustrated by a bullet 30 having a characteristic cross-sectional shape including a rounded leading edge 32 and a trailing edge 34. The bullet 30 is formed from the previously mentioned composite material protruded with resin 36 surrounding the fibers 38 in a co-axial direction wherein the lengths of the fibers 38 are directed to the projectile direction. The rounded leading edge 32 and trailing edge 34 expose the fibers 38. In this embodiment, the FRP fibers 38 are used in combination with a single mass 40 which can be formed from material resin or include filler, such as copper. Use of copper strands 39 will cause the bullet to mushroom upon impact. Optionally, an outer jacket 42 can be placed over the exposed resin and fibers.

Figure 3A:
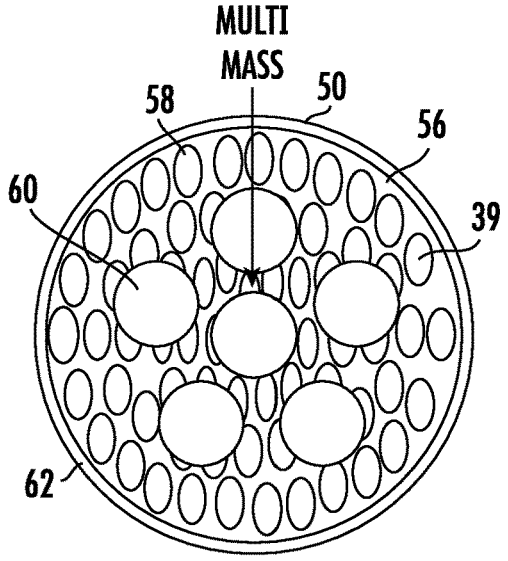
FIG. 3A is an end view of a multi-mass FRP bullet.
Figure 3B:
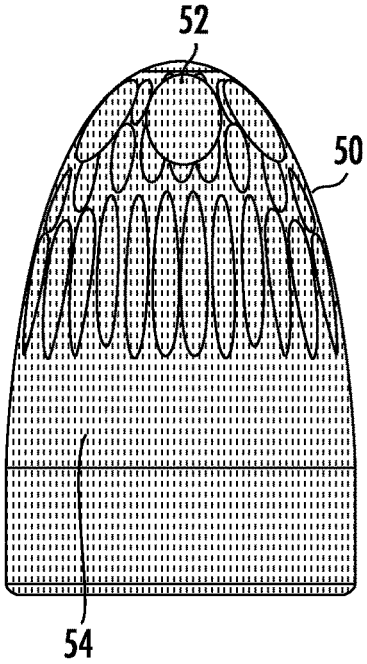
FIG. 3B is a cross-sectional side view of the multi-mass FRP bullet illustrated in FIG. 3A.
Figure 3C:
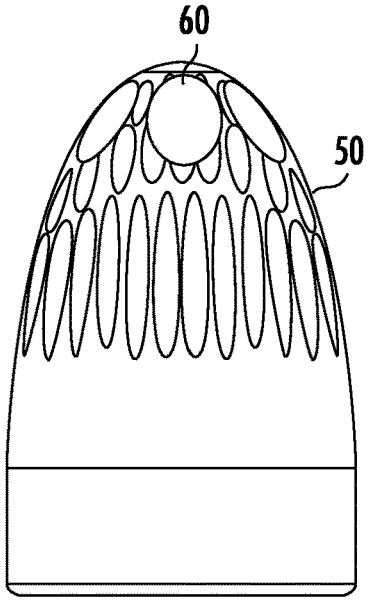
FIG. 3C is a side view of the multi-mass FRP bullet illustrated in FIGS. 3A & 3B.

Referring to FIGS. 3A-3C, in this embodiment a bullet 50 has a characteristic cross-sectional shape including a rounded leading edge 52 and a trailing edge 54. The bullet 50 is formed from the previously mentioned composite material protruded with resin 56 surrounding the fibers 58 in a co-axial direction wherein the lengths of the fibers 58 are directed to the projectile direction. The rounded leading edge 52 and trailing edge 54 expose the fibers 58. In this embodiment, the FRP fibers 58 are used in combination with multi-mass 60, which can be formed from material resin or include filler, allowing a particular impact. The multi-mass 60 will cause the bullet to mushroom or fragment upon impact. Optionally, an outer jacket 62 can be placed over the exposed resin and fibers.

Figure 4:
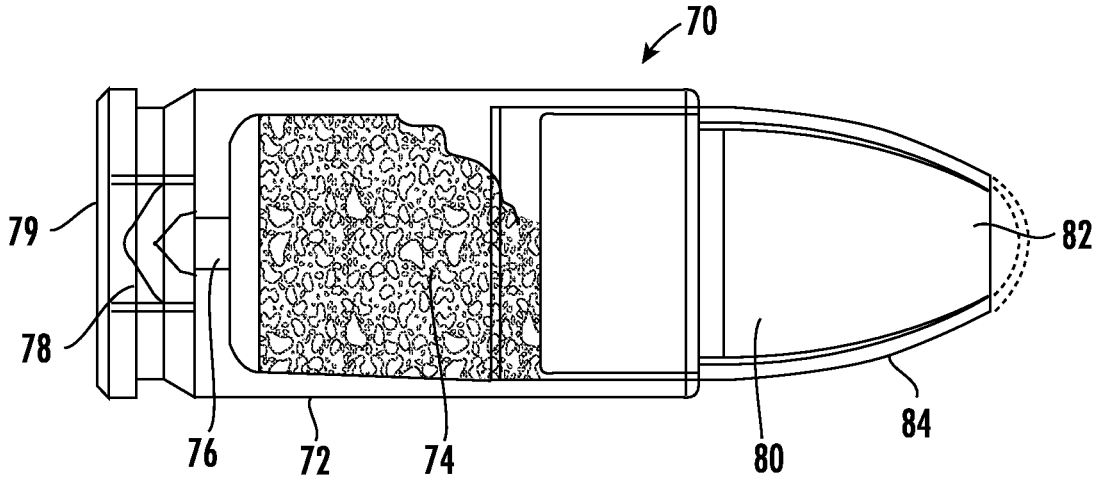
FIG. 4 PRIOR ART
FIG. 4 is a cross-sectional side view of a conventional bullet.

Referring to FIG. 4, depicted is a conventional bullet 70 found in the prior art, having a cartridge case 72, containing a powder propellant 74. A flash hole 76 leads to a primer 78 which is constructed and arranged to receive a firing pin, not shown, along the trailing end 79. The bullet 70 contains lead or a lead alloy core 80 forming the leading end 82. The core 80 is typically jacketed 84 with metal.

Figure 5:
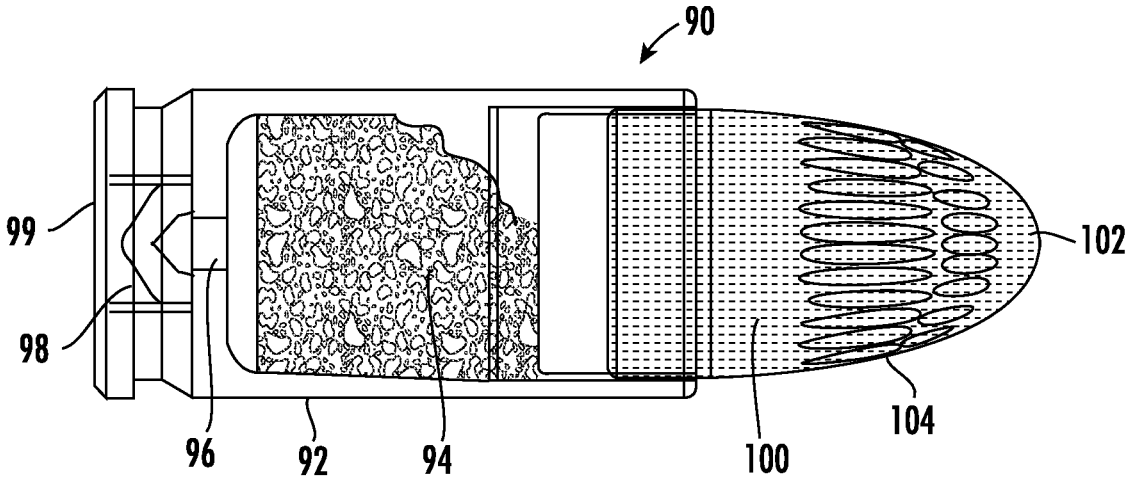
FIG. 5 is a cross-sectional side view of a bullet made from the method of the instant invention.

Referring to FIG. 5, depicted is a bullet 90 of the instant invention having a cartridge case 92 containing a powder propellant 94. A flash hole 96 leads to a primer 98 which is constructed and arranged to receive the firing pin along the trailing end 99. The bullet 90 of the instant invention having the FRP core 100 forming the leading end 102. The core 100 may be jacketed 104 depending on the desired result. The core 100 may be FRP only, or single mass or multi-mass as previously described. As opposed to malleable lead or copper, basalt/epoxy is hard and the projectile can be made lethal. However, unlike lead, they are nontoxic and lighter weight to carry. Light weight also means less kinetic energy, therefore they don't tend to ricochet or do damage beyond the first hit. The ability to apply a continuous glass fiber overcoat to a steel or copper wire as a core can make the projectile more armor piercing than just the parallel columns of basalt glass fiber alone.

Figure 6:
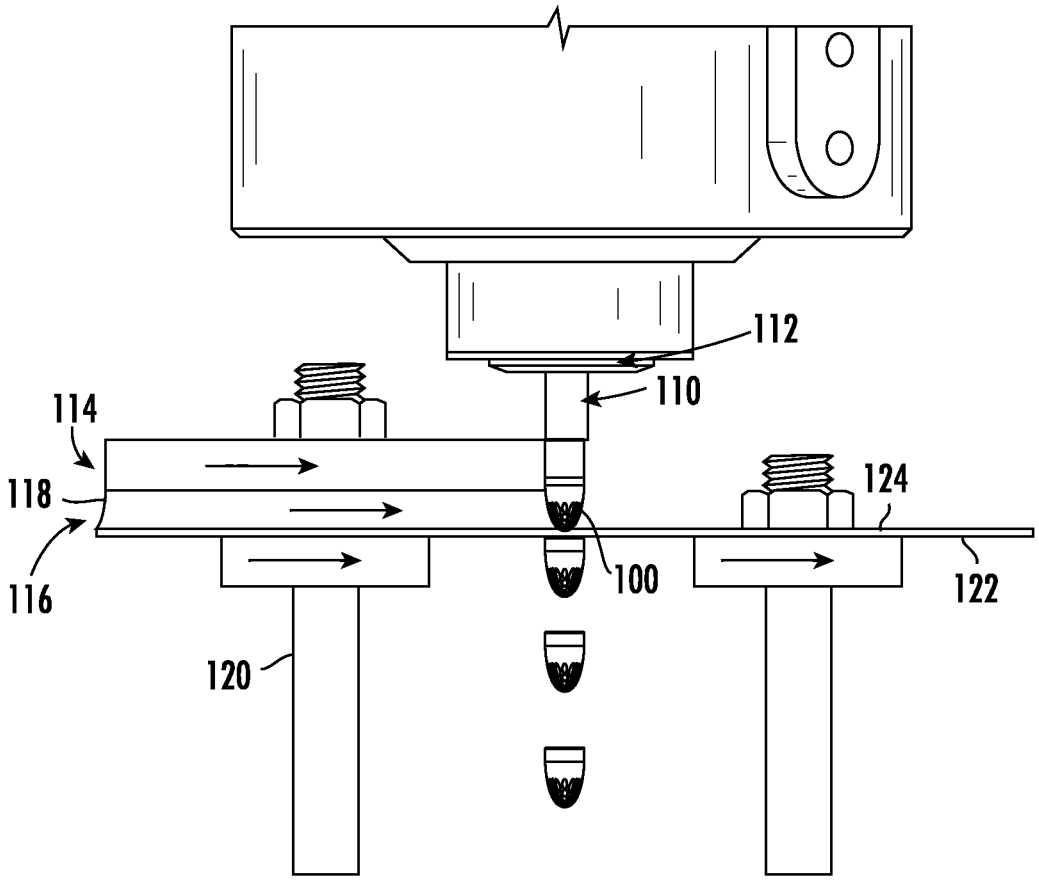
FIG. 6 is a pictorial view of a bar stock grinder.
Figure 7:
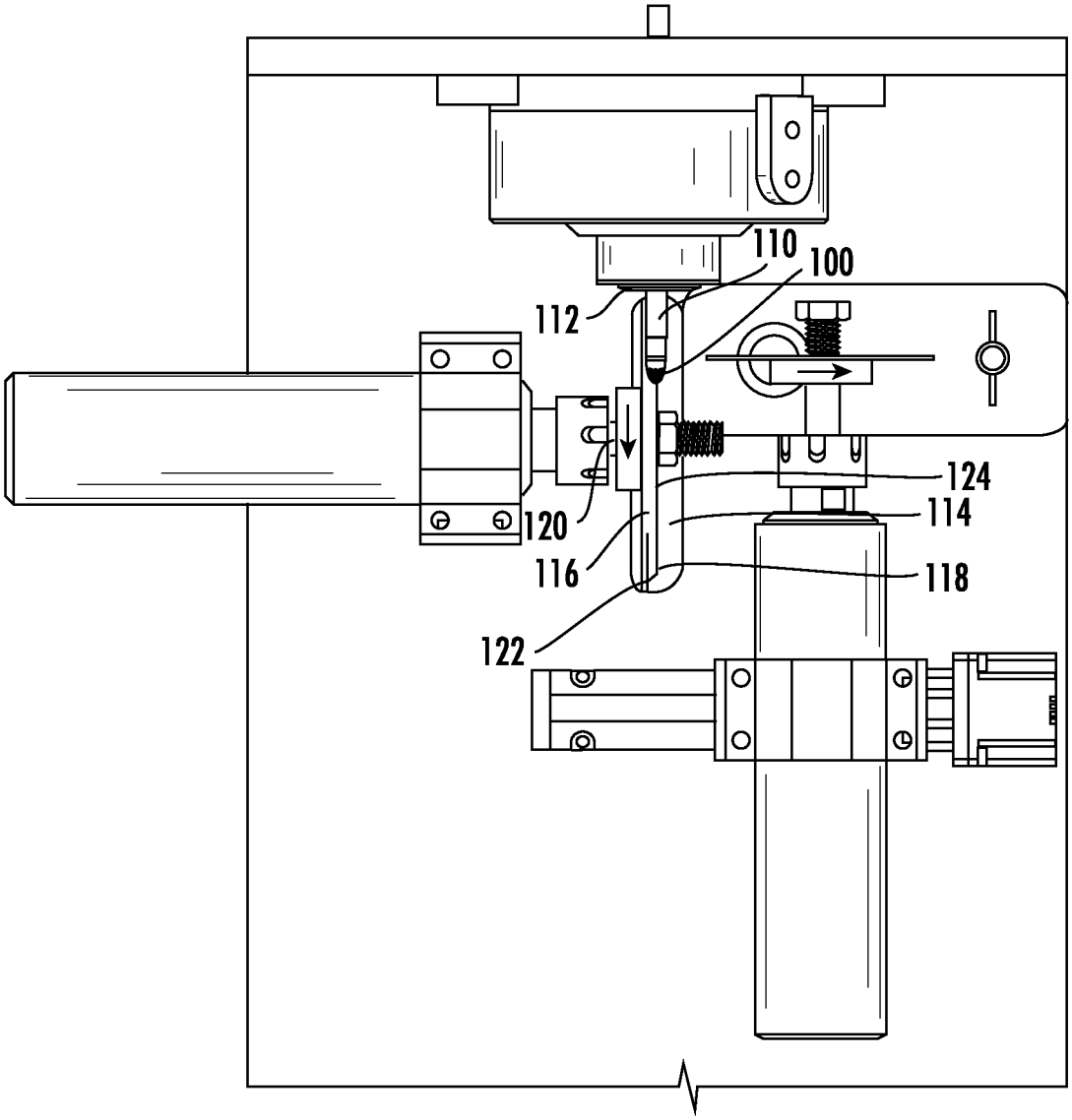
FIG. 7 is a perspective view of the bar stock grinder.

Referring to FIG. 6, the bullet of the present invention is first formed by forming an FRP bar stock wherein the fiber reinforcing members produced using continuous basalt fibers (CBF) are placed coaxial in an appropriate adhesive matrix, be it a thermo plastic or a thermo set epoxy, vinyl ester or urethane to add rigidity in a direction that accepts the instantaneous velocity change. The CBF reinforcing members are formed from multiple strands to produce the required strength for the compression predictions in a similar manner used to calculate lead bullet projections. The micron size of the basalt fiber may be altered as necessary. Continuous basalt fiber is manufactured from basalt filaments made by melting crushed volcanic rock of a specific mineral mixture, known as a breed, and drawing the molten material into fibers. The fibers cool to form hexagonal chains resulting in a resilient structure having a substantially high strength at less weight and are non-toxic. After the protrusion process where the reinforcing and matrix materials are combined, the material is compacted and processed in a drawn format wherein all fibers are co-axially placed into a reinforcement bar matrix. As previously described, the fibers making the bar matrix may be FRP only, single mass or multi-mass. By adjustment to the elastic nature of the adhesive polymer bonding the parallel glass filaments of an FRP projectile, the projectile can exhibit a consistently robust ability to survive the loading process, launch and leave the barrel intact, yet disintegrate on impact if desired. The parallel placement of the strands provides columnar strength.

The use of single mass or multi-mass can be used with different materials to increase the projectile weight. For example, steel or stainless-steel wire core has the potential to double the mass weight of FRP alone and provide some armor piercing ability. FRP overlaying copper wire has the potential to exhibit malleable buckling upon impact, perhaps similar to traditional lead or copper projectiles.

The process uses FRP rods 110 held by a revolving collet 112 that is interfaced with an upper diamond grit OD grinder 114 and a lower diamond grit profile wheel 116 having a cutting surface 118 constructed and arranged to cut the leading edge of the bullet. The upper grinder 114 draws the FRP rods 110 to an exact outer dimension for placement in the cartridge 92. The lower grinder 116 then diamond grinds and cuts the bullet to a perfect dimension. In one embodiment, the upper grinder and lower profile wheel 114, 116 are rotatable on a common shaft 120. A diamond cut off wheel 122 allows for a continuous process, allowing efficiencies in production. In one embodiment, the method includes the steps of forming 10 mm pultruded basalt glass rods with or without fillers. The rods are typically 3 meters long, stand vertically in a pipe, and gravity feed through a spinning pneumatic 10 mm collet 112. The rod is stopped by a smooth Teflon coated side 124 of the diamond edge cut off wheel 122. Linear slides move the cutter 122 and profiler wheels 114, 116 in and out.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Likewise, a step of a method or an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A bullet comprising: a substantially cylindrical shell having a predetermined longitudinal length and diameter, said shell formed from a polymeric material protruded with a resin and fibers, said fibers positioned in a co-axial direction wherein lengths of said fibers are directed in-line along a longitudinal length of said shell and extending to, a rounded leading edge exposing each end of said fibers, said shell having a trailing end coupled to a cartridge case containing a propellant wherein said propellant is capable of generating controlled expansion of gases, wherein said fibers are used in combination with a single mass formed from copper strands, wherein said single mass allows said bullet to mushroom upon impact.

2. The bullet according to claim 1, including an outer jacket positioned over said exposed fibers on said rounded leading edge.

3. The bullet according to claim 1, wherein said resin is selected from the group consisting of: polyester resins, vinyl ester resins, epoxy resins, phenolic resins, polyimide resins, polyamide resins, polypropylene resins, PEEK resins, methacrylate resins, and any combinations thereof.

4. The bullet according to claim 1, wherein said fiber is basalt.

5. The bullet according to claim 1, wherein said fiber may be selected from the group consisting of: glass, nylon, polyamides, aromatic polyamides, Kevlar®, polyethylene, polyethylene terephthalate, copper, steel, titanium, carbon, and any combinations thereof.

6. The bullet according to claim 1, wherein said fiber material can be woven, braided or otherwise processed into a fabric or other suitable configuration.

7. A bullet comprising: a substantially cylindrical shell formed from a polymeric material protruded with a resin and basalt fibers, said fibers positioned in a co-axial direction wherein lengths of said fibers are directed in-line along the longitudinal length of said shell, said shell having a rounded leading edge exposing each end of said fibers, and a cartridge case a propellant wherein said propellant is capable of generating controlled expansion of gases, wherein said fibers are used in combination with a substantially cylindrical multi-mass centrally disposed throughout said shell formed from material resin or include filler, wherein said multi-mass allows a particular impact.

8. The bullet according to claim 7, including an outer jacket placed over said exposed resin and said basalt fibers on said rounded leading edge.

9. The bullet according to 7, wherein said resin is selected from the group consisting of: polyester resins, vinyl ester resins, epoxy resins, phenolic resins, polyimide resins, polyamide resins, polypropylene resins, PEEK resins, methacrylate resins, and any combinations thereof.

10. The bullet according to claim 7, includes a single mass formed from copper strands, wherein said single mass allows said bullet to mushroom upon impact.

11. A method for manufacturing a fiber reinforced polymeric bullet, comprising the steps of:

forming a fiber reinforced polymeric (FRP) bar stock wherein the fiber reinforcing members produced using continuous basalt fibers (CBF) are placed coaxial in an appropriate adhesive matrix;

holding said FRP bar by a revolving collet that is interfaced with an upper diamond grit OD grinder and a lower diamond grit profile wheel having a cutting surface constructed and arranged to cut the leading edge of said bullet;

drawing the FRP bar by said upper diamond grit OD grinder to an exact outer dimension for placement in a cartridge;

grinding and cutting said bullet by said lower grinder to a perfect dimension;

stopping the FRP bar stock by a smooth Teflon coated side of a diamond edge cut off wheel;

moving said diamond edge cut off wheel and said upper grinder and said lower profile wheel by linear slides.

12. The method as in claim 11 wherein said adhesive matrix includes a thermos plastic or a thermos set epoxy, vinyl ester or urethane to add rigidity in a direction that accepts the instantaneous velocity change.

13. The method as in claim 11, said method further comprising:

manufacturing said continuous basalt fiber (CBF) from basalt filaments made by melting crushed volcanic rock of a specific mineral mixture, known as a breed;

drawing said breed into fibers;

cooling said fibers to form hexagonal chains resulting in a resilient structure having a substantially high strength at less weight and are non-toxic.

14. The method as in claim 11, wherein said fibers making said mineral mixture may be fiber reinforced polymer only, single mass or multi-mass.

15. The method as in claim 11, wherein said upper grinder and said lower profile wheel are rotatable on a common shaft.

16. The method as in claim 11, wherein said FRP bar stock is gravity fed through said revolving collet.

* * * * *